US012313384B2

(12) United States Patent
Puha

(10) Patent No.: US 12,313,384 B2
(45) Date of Patent: May 27, 2025

(54) LESS-LETHAL PROJECTILES AND CARTRIDGES

(71) Applicant: EIGHT HOLDINGS LLC, Coeur D'Alene, ID (US)

(72) Inventor: Teodor Puha, Coeur D'Alene, ID (US)

(73) Assignee: Eight Holdings LLC, Coeur D'Alene, ID (US)

( * ) Notice: Subject to any disclaimer, the term of this patent is extended or adjusted under 35 U.S.C. 154(b) by 0 days.

(21) Appl. No.: 18/662,811

(22) Filed: May 13, 2024

(65) Prior Publication Data

US 2024/0384973 A1 Nov. 21, 2024

Related U.S. Application Data

(60) Provisional application No. 63/467,483, filed on May 18, 2023.

(51) Int. Cl.
*F42B 12/34* (2006.01)
*F42B 12/72* (2006.01)

(52) U.S. Cl.
CPC ..... *F42B 12/34* (2013.01); *F42B 12/72* (2013.01)

(58) Field of Classification Search
CPC .. F42B 12/46; F42B 8/02; F42B 12/40; F42B 12/50; F42B 12/34; F42B 8/08
USPC ..... 102/501, 502, 512, 498
See application file for complete search history.

(56) References Cited

U.S. PATENT DOCUMENTS

| | | | | |
|---|---|---|---|---|
| 4,823,702 A * | 4/1989 | Woolsey | F42B 12/34 | 102/502 |
| 5,009,164 A * | 4/1991 | Grinberg | F42B 12/40 | 102/501 |
| 6,374,742 B1 * | 4/2002 | Brunn | F42B 12/34 | 102/444 |
| 7,690,311 B1 * | 4/2010 | Cronemberger | F42B 12/40 | 102/512 |
| 7,861,657 B2 * | 1/2011 | Danon | F42B 30/02 | 102/502 |
| 8,020,492 B1 * | 9/2011 | Kapeles | F42B 10/02 | 102/512 |

* cited by examiner

*Primary Examiner* — Reginald S Tillman, Jr.
(74) *Attorney, Agent, or Firm* — Eric B. Fugett; Mark A. Pitchford; Pitchford Fugett, PLLC

(57) ABSTRACT

A less-lethal projectile includes a cylindrical flexible body. The body includes a nose, a conical tail, and a tubular sidewall. The tail and sidewall extend rearwardly away from the nose. The sidewall defines an interior space around the tail. A flowable medium is received in the interior space around the tail. The flowable medium is configured to deform the sidewall upon impact of the nose with a target such that a portion of the sidewall contacts the target around the nose. Impact of the nose with the target causes the flowable medium to move forward in the interior space around the tail and expand the sidewall radially outward and forward such that the sidewall contacts the target around the nose.

16 Claims, 4 Drawing Sheets

LESS-LETHAL PROJECTILES AND CARTRIDGES

CROSS-REFERENCES TO RELATED APPLICATIONS

This non-provisional patent application claims priority to U.S. Provisional Patent Application Ser. No. 63/467,483, filed May 18, 2023 and titled "LESS-LETHAL PROJECTILES AND CARTRIDGES," the entire disclosure of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

Less-lethal projectiles, cartridges, and weapons are designed to minimize injury or death by incapacitating instead of killing a target. Kinetic less-lethal rounds, such as rubber bullets and beanbag rounds, rely on the transfer of kinetic energy and blunt force trauma to accomplish this incapacitation. Although rare, fatalities from kinetic less-lethal projectiles sometimes occur when a vital or delicate area is impacted. This is due in part to the fact that conventional kinetic less-lethal rounds generally impact a very small area on a human target with very high pressure. The area of impact is typically limited to and defined by the caliber (i.e., size) of the projectile. This delivers all the energy of the projectile into the impacted area all at once, which can break bones, injure underlying organs, and in some cases, even penetrate skin. Accordingly, what is needed are improvements in less-lethal projectiles and cartridges for firearms and other weapons.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

It is an object of the present invention to provide less-lethal projectiles and cartridges for firearms and other weapons. A less-lethal projectile of the present invention can include a flexible cylindrical body having a nose, a conical tail extending rearwardly from the nose, and a tubular sidewall extending rearwardly from the nose around the tail.

The sidewall defines an interior space into which the tail extends. A flowable medium is received in the interior space around the tail. The sidewall can extend rearwardly from the nose beyond the tail such that the flowable medium surrounds the tail in the interior space. Upon impact of the nose with a target, the momentum of the flowable medium causes it to move forward in the interior space around the conical tail. The conical tail redirects some of the flowable medium radially outward. The redirected flowable medium deforms or expands the sidewall radially outward while the momentum of the flowable medium continues to carry it generally forward around the nose, thereby causing the radially expanded sidewall to contact the target around the nose. This distributes force on the contact surface over a wider area than just the area defined by the nose alone, and increases projectile deceleration time, thereby decreasing the peak pressure allied to the impacted area without decreasing overall energy delivered to the target by the projectile. This in turn advantageously decreases the chance of skin penetration and severe injury, while still delivering the necessary force to deter or incapacitate human targets.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

DETAILED DESCRIPTION

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
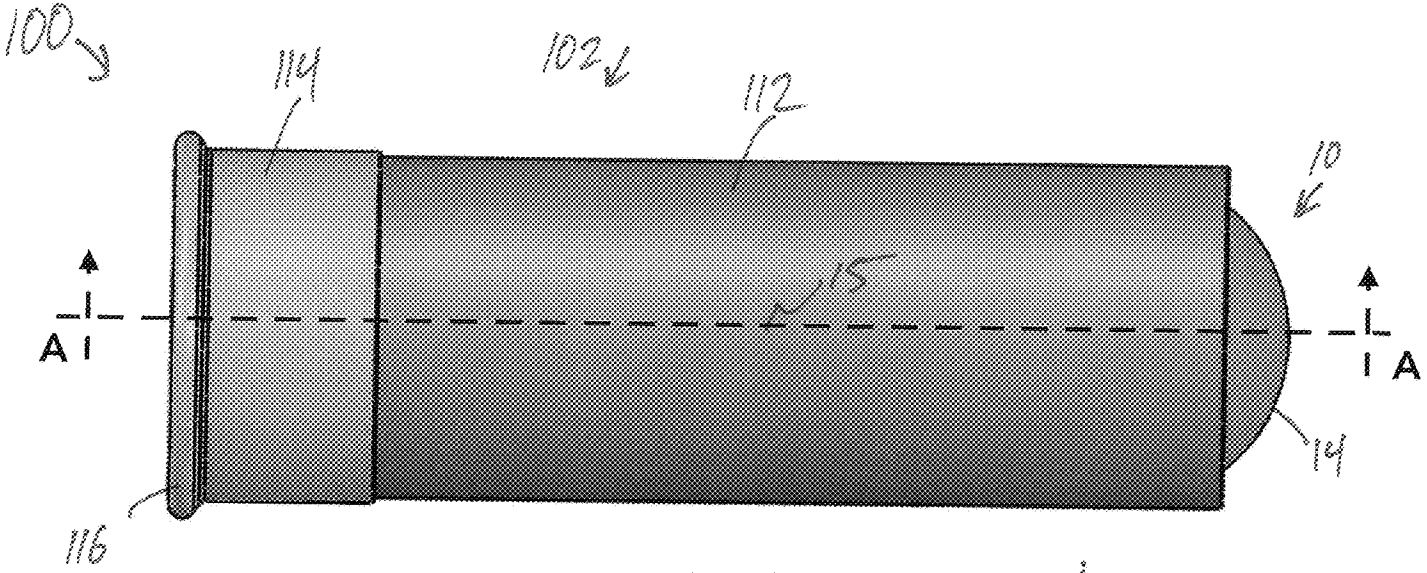
FIG. 1 is a side elevational view of a cartridge for a firearm containing a less-lethal projectile constructed in accordance with an embodiment of the present invention.
Figure 2:
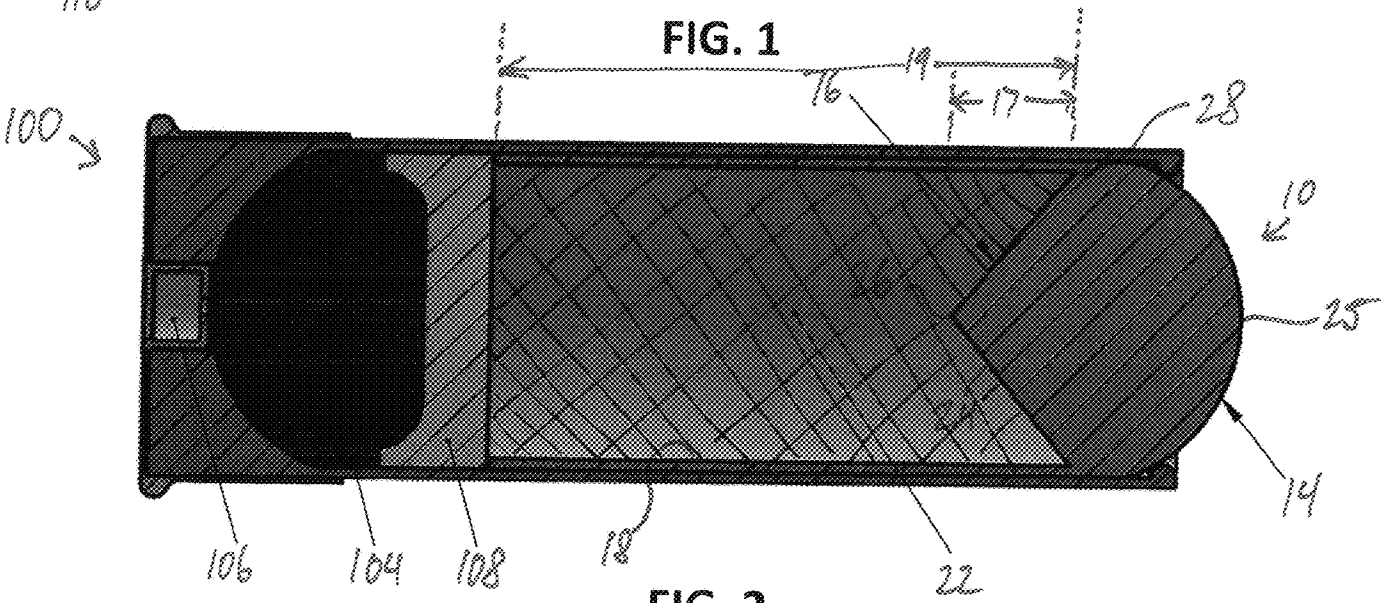
FIG. 2 is a section view taken along line A-A of FIG. 1.
Figures 3, 4:
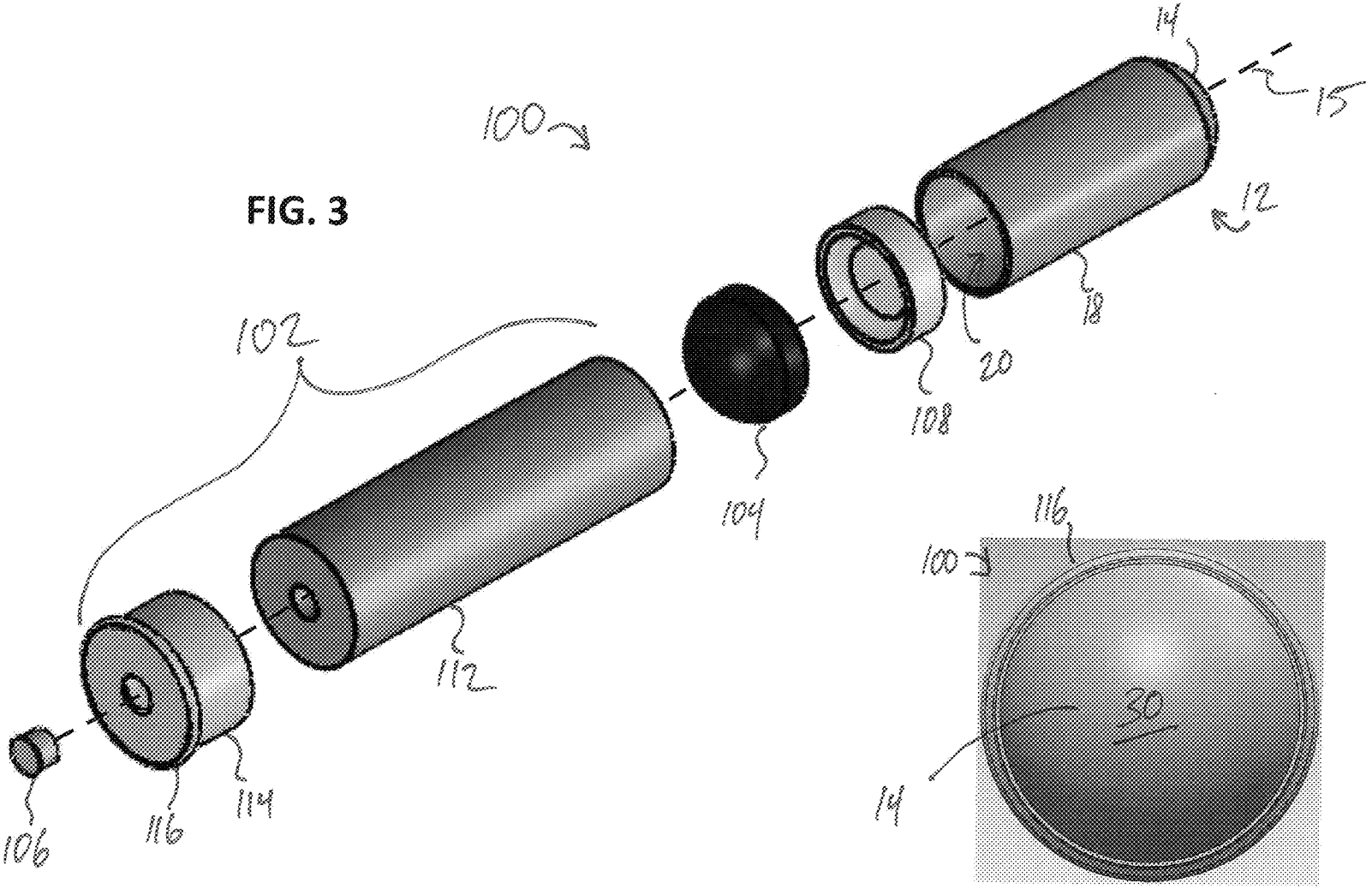
FIG. 3 is an exploded perspective view of the cartridge of FIG. 1. The flowable medium is omitted for clarity.
FIG. 4 is a front elevational view of the cartridge of FIG. 1.

As described herein, an "upright" position is considered to be the position of apparatus components while in proper operation or in a natural resting position as described and shown herein, for example, in FIG. 1. The upright firing position of a firearm is a generally level firing position. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

As used herein, the terms "front" and "forward" means in a direction extending toward the muzzle of the firearm. In some cases, the term "forward" can also mean forward beyond the muzzle of the firearm. The terms "aft" and "rear" means in a direction extending away from the muzzle of the firearm toward a rear end of a firearm. In some cases, the term "rearward" can also mean rearward beyond the rear end of the firearm.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

The terms "significantly", "substantially", "approximately", "about", "relatively," or other such similar terms that may be used throughout this disclosure, including the claims, are used to describe and account for small fluctuations, such as due to variations in manufacturing or processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

The term "substantially" as used herein means what is considered normal or possible within the limits of applicable industry-accepted manufacturing practices and tolerances.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Referring now to FIGS. 1-4, there is depicted a cartridge 100 for a firearm (not shown) containing a less-lethal projectile 10 constructed in accordance with an embodiment of the present invention. The cartridge 100 includes a shell case 102, propellant 104, a primer 106, a gas seal 108, and the less-lethal projectile 10, which is described in more detail below. The primer 106 is configured to ignite the propellant 104 when struck by a firing pin of the firearm. The gas seal 108 is seated in the shell case 102 between the propellant 104 and the projectile 10. The projectile 10 is seated in an open end of the shell case 102 opposite the primer 106. Ignition of the propellant 104 by the primer 106 expels the gas seal 108 and the projectile 10 out of the open end of the shell case 102 and through the barrel of the firearm toward a target 120.

Figure 5:
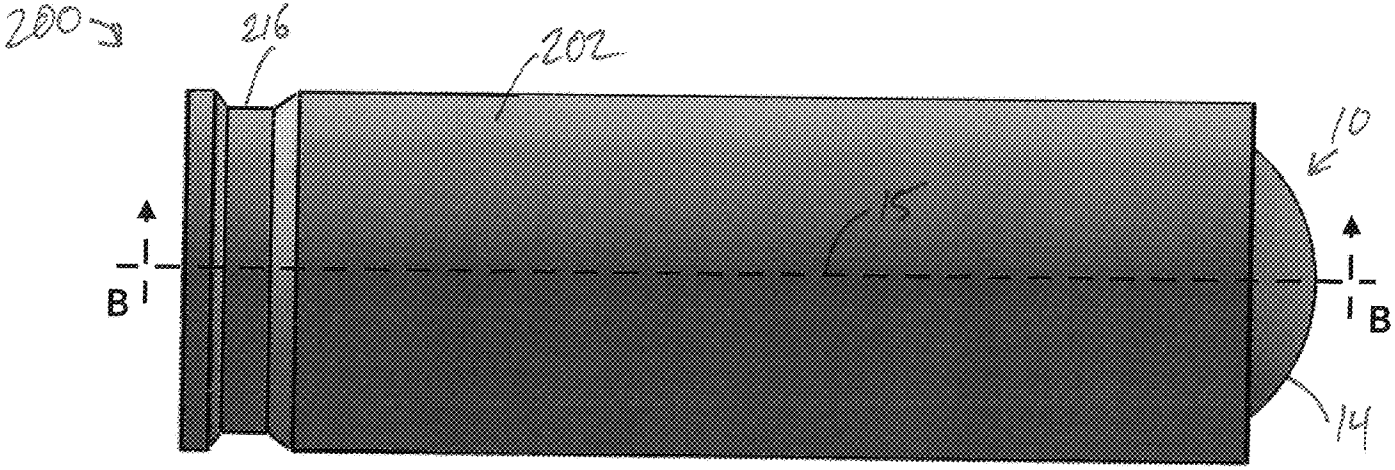
FIG. 5 is a side elevational view of another embodiment of a cartridge for a firearm containing the projectile of FIG. 1.
Figure 6:
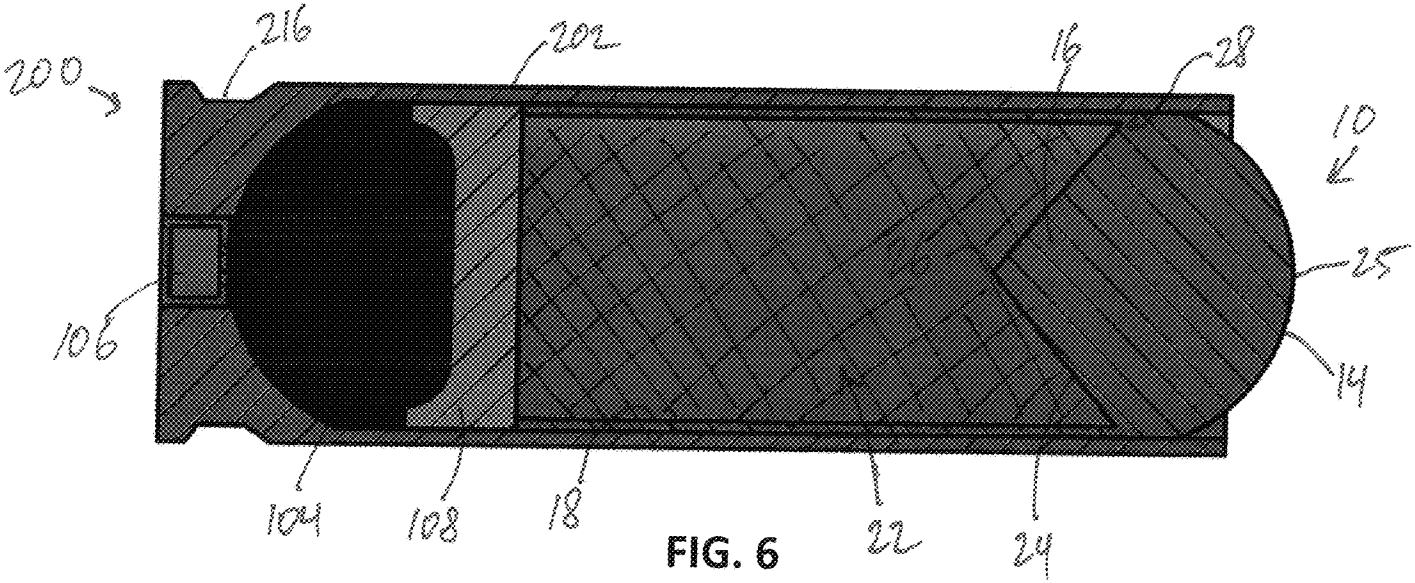
FIG. 6 is a section view taken along line B-B of FIG. 5.
Figures 7, 8, 9:
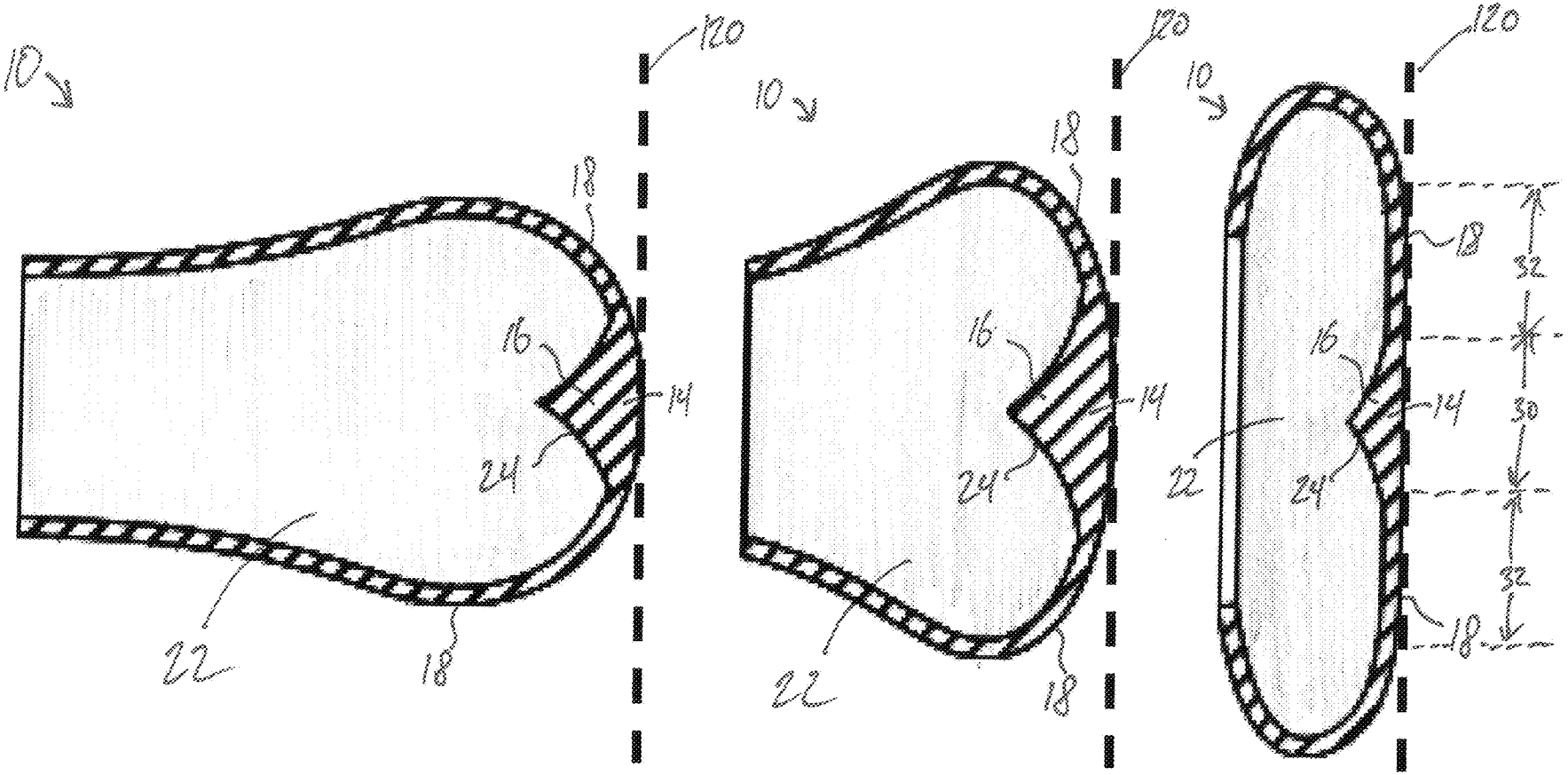
FIG. 7 is a longitudinal section view of the projectile of FIG. 1 showing deformation of the projectile upon initial impact of the projectile with a target.
FIG. 8 is another longitudinal section view of the projectile of FIG. 1 showing deformation of the projectile half way through impact of the projectile with the target.
FIG. 9 is yet another longitudinal section view of the projectile of FIG. 1 showing deformation of the projectile at full impact of the projectile with the target.

In the exemplar embodiment depicted in FIGS. 1-4, the cartridge 100 is a shotgun cartridge 100. As such, the shell case 102 is a shotshell including a hull 112 and a case head 114 defining a rim 116. The primer 106 is seated in the case head 114. However, in other embodiments, the shell case 102 can instead be a rimless shell case 202 with an extractor groove 216, as exemplified by the alternate cartridge 200 depicted in FIGS. 5-6. Other types of cartridges and shell cases suitable for use with the less-lethal projectiles 10 of the present invention will be apparent to those of ordinary skill in the art. In each such embodiment, the shell case 102, 202, propellant 104, primer 106, and gas seal 108 can be formed using well known materials and processes. Projectiles 10 of the present invention are suitable for use in cartridges for all large bore weapon platforms, including but not limited to 12-gauge shotguns, 37 mm gas guns, 40 mm grenade launchers, as well as .50 caliber and .68 caliber air guns.

The less-lethal projectile 10 includes a flexible cylindrical body 12 defining a longitudinal axis 15. The body 12 includes a nose 14, a conical tail 16, and a tubular sidewall 18 defining an interior space 20. A flowable medium 22 is received in the interior space 20. The body 12 can be formed from any suitably flexible and durable material that does not tend to shatter or tear upon impact with a human target, including but not limited to various natural and synthetic polymers, such as rubber. The tail 16 extends a distance 17 rearwardly from the nose 14 inside the interior space 20 and along the longitudinal axis 15. The tail 16 includes a slanted face 24 and a vertex 26. The face 24 slants toward the axis 15 from the nose 14. The longitudinal axis 15 extends through a center 25 of the nose and the vertex 26 of the tail 16. Although the nose 14 is depicted as convex, in other embodiments, the nose 14 can be flat or concave.

The sidewall 18 extends a distance 19 rearwardly from a periphery 28 of the nose 14 parallel to the longitudinal axis 15. The distance 19 that the sidewall 18 extends from the nose 14 is greater than the distance 17 that the tail 16 extends from the nose 14. In this way, the sidewall 18 extends like a skirt rearwardly from the nose 14 beyond the tail 16 and defines the interior space 20 around the tail 16. This ensures that the interior space 20 is large relative to the conical tail 16, which in turn enables the flowable medium 22 to deform or expand more of the sidewall 18 into contact with a target upon impact by the projectile 10, as described below. The sidewall 18 is configured to be thin relative to the nose 14 so that it easily deforms upon impact of the nose 14 with a target 120 and expands into contact with the target 120 around the nose 14.

The flowable medium 22 is received in the interior space 20 around the tail 16 such that the flowable medium 22 substantially surrounds the tail 16. The medium 22 is configured to deform the sidewall 18 upon impact of the nose 14 with a target 120 such that the sidewall 18 expands into contact with the target 120 around the nose 14. More specifically, the flowable medium 22 comprises a flowable material having sufficient density (relative to the body 12) to deform the sidewall 18 upon impact of the nose 14 with a human target 120 when the projectile is traveling at a velocity of about 300 feet per second or more. In some embodiments, the flowable medium 22 has a density that is greater than the density of the constituent material from which the flexible body 12 is formed. However, the density of the flowable medium 22 need only be great enough that the momentum of the flowable medium 22 is sufficient to deform the sidewall upon impact of the nose 14 with a target 120 when the projectile is traveling at a velocity of about 300 feet per second or more. Suitable flowable materials 22 include viscous liquids such as gels, granular or particulate materials such as powders, sand, beads, and the like, formed from one or more metallic (e.g., iron, copper, lead, or steel) or non-metallic (e.g., silica, glass, rubber, sand) substances. However, the use of non-metallic substances to form the flowable medium 22 reduces the risk of serious injury.

In use, impact of the nose 14 with a target 120 causes the momentum of the flowable medium 22 to carry the flowable medium 22 longitudinally forward in the interior space 20 around the conical tail 1. This redirects some of the medium 22 radially outward which in turns expands the sidewall 18 radially outward. This redirection of the flowable medium 22 inside the interior space 20 also increases the amount of time the projectile 10 has to decelerate, which decreases the peak pressure allied to the impacted area (i.e., areas 30 and 32) without decreasing overall energy delivered to the target 120 by the projectile 10. The momentum of the medium 22 continues to carry it and the radially expanded portion of the sidewall 18 longitudinally forward such that a portion of the sidewall 18 contacts the target 120 around the nose 14. The area of the target contacted (i.e., impacted) by the expanded sidewall 18 is greater than the area 30 of the target 120 contacted by the nose 14 alone. In some embodiments, the portion of the sidewall 18 that contacts the target 120 around the nose 14 defines an area 32 greater than an area 30 defined by a periphery 28 of the nose 14. As such, the nose defines a first area 30, the portion of the sidewall that contacts the target upon impact defines a second area 32 that is greater than the first area 30.

Although embodiments of the present invention have been described in detail, it will be understood by those skilled in the art that various modifications can be made therein without departing from the spirit and scope of the invention as set forth in the appended claims. For example, although the less-lethal projectiles and cartridges disclosed herein have generally been described in the context of projectiles and cartridges for firearms, it is to be understood that the less-lethal projectiles disclosed herein can be adapted for use in other projectile launching weapons specifically including, but not limited to, air guns. Additionally, it is also to be understood that in some embodiments the flowable medium 22 used in less-lethal projectiles 10 disclosed herein can advantageously comprise or consist of one or more chemical irritants in a flowable form, such as a liquid, a gel, or a granular or particulate material such as powder. For example, in some embodiments, the flowable medium 22 can be include a powder containing an irritant such as capsaicin, oleoresin capsicum, pelargonic acid vanillylamide (PAVA), and the like, or analogs or derivatives thereof. In other embodiments, the flowable medium 22 can be an inert, non-irritant payload powder. In some embodiments, the flowable medium 22 can be paint or dye. In additional embodiments, the flowable medium 22 can include a paint or dye and a particulate substance, such as sand, glass beads, or polymeric beads.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A less-lethal projectile, comprising:

a flexible body having a nose, a conical tail, and a sidewall defining an interior space around the tail; and a flowable medium in the interior space configured to deform the sidewall upon impact of the nose with a target such that at least a portion of the sidewall contacts the target around the nose.

2. The projectile of claim 1, wherein:

the flowable medium surrounds the tail in the interior space.

3. The projectile of claim 1, wherein:

the sidewall extends rearwardly from the nose; and the tail extends rearwardly from the nose inside the interior space.

4. The projectile of claim 1, wherein:

the sidewall extends rearwardly from a periphery of the nose; and the tail extends rearwardly from the nose into the interior space.

5. The projectile of claim 1, wherein:

the tail extends rearwardly from the nose inside the interior space; and the sidewall extends rearwardly from the nose beyond the conical tail.

6. The projectile of claim 1, wherein:

the body defines a longitudinal axis extending through the nose and tail; and impact of the nose with the target causes the flowable medium to move longitudinally forward in the interior space around the tail and expand the sidewall radially outward and longitudinally forward such that the sidewall contacts the target around the nose.

7. The projectile of claim 1, wherein:

the body defines a longitudinal axis;

the longitudinal axis extends through a center of the nose and a vertex of the tail;

the sidewall extends rearwardly from a periphery of the nose parallel to the longitudinal axis; and the tail extends rearwardly along the longitudinal axis from the nose.

8. The projectile of claim 7, wherein a face of the tail slants toward the longitudinal axis from the nose.

9. The projectile of claim 1, wherein:

the conical tail extends a first distance rearwardly from the nose;

the sidewall extends a second distance rearwardly from the nose; and and the second distance is greater than the first distance.

10. The projectile of claim 1, wherein the portion of the sidewall that contacts the target defines an area greater than an area defined by a periphery of the nose.

11. The projectile of claim 1, wherein:

the nose defines a first area;

the portion of the sidewall that contacts the target upon impact defines a second area; and the second area is greater than the first area.

12. The projectile of claim 1, wherein:

the flexible body has a first density; and the flowable medium has a second density; and the second density is greater than the first density.

13. A cartridge, comprising:

a shell case;

a propellant in the case;

a primer on the case configured to ignite the propellant;

the less-lethal projectile of claim 1 in the case; and a gas seal in the case between the propellant and the projectile.

14. The cartridge of claim 13, wherein:

the shell case includes a hull and a case head defining a rim; and the primer is seated in the case head.

15. A less-lethal projectile, comprising:

a flexible cylindrical body defining a longitudinal axis, the body having a nose, a conical tail extending longitudinally rearward from the nose, and a tubular sidewall extending longitudinally rearward from a periphery of the nose, the sidewall defining an interior space into which the tail extends; and a flowable medium received in the interior space around the tail;

wherein impact of the nose with a target causes the flowable medium to move longitudinally forward in the interior space around the tail and deform the sidewall radially outward and longitudinally forward such that the sidewall contacts the target around the nose.

16. A cartridge, comprising:

a shell case including a hull and a case head defining a rim;

a propellant in the case;

a primer seated in the case head configured to ignite the propellant;

the less-lethal projectile of claim 15 in the case; and a gas seal in the case between the propellant and the projectile.

* * * * *